US007257343B2

(12) United States Patent
Inoue et al.

(10) Patent No.: US 7,257,343 B2
(45) Date of Patent: Aug. 14, 2007

(54) IMAGE FORMING APPARATUS PERFORMING POST TREATMENT ACCOMPANIED WITH PERFORATION

(75) Inventors: Yasuhiro Inoue, Yamatokoriyama (JP); Shigeharu Maehara, Nara (JP); Kazuya Iwabayashi, Tenri (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 171 days.

(21) Appl. No.: 11/055,953

(22) Filed: Feb. 11, 2005

(65) Prior Publication Data

US 2005/0185979 A1 Aug. 25, 2005

(30) Foreign Application Priority Data

Feb. 20, 2004 (JP) ..... 2004-045359

(51) Int. Cl.
*G03G 15/00* (2006.01)

(52) U.S. Cl. ..... 399/82; 399/407; 399/410

(58) Field of Classification Search ..... 399/82, 399/407, 408, 410; 156/513, 514, 250, 252; 270/37, 52.02, 58.07, 58.08
See application file for complete search history.

(56) References Cited

U.S. PATENT DOCUMENTS 4,822,446 A * 4/1989 Hansen ..... 156/513
6,088,568 A * 7/2000 Ohtani ..... 399/408
6,325,585 B1 * 12/2001 Sasaki et al. ..... 270/37
6,928,259 B2 * 8/2005 Sakuma ..... 399/407

FOREIGN PATENT DOCUMENTS

| | | |
|---|---|---|
| JP | 09-123098 | 5/1997 |
| JP | 10-129171 | 5/1998 |
| JP | 11-091283 | 4/1999 |

* cited by examiner

*Primary Examiner*—William J. Royer
(74) *Attorney, Agent, or Firm*—Renner, Otto, Boisselle & Sklar, LLP

(57) ABSTRACT

An additional image is formed on a recording medium by filling a predetermined area including a punched portion or a stapled portion, in addition to an image which is to be formed originally, such as a text document. The additional image is formed with white developer or transparent developer. Since the thickness of the recording medium is increased by the white developer or transparent developer forming the additional image portion, the region around the punched portion or the stapled portion is reinforced and the recording medium is kept from being broken easily. When the image and the additional image are superposed, the superposition of the image and the additional image is avoided by either reducing the image or changing the position of the image to be formed.

18 Claims, 6 Drawing Sheets

IMAGE FORMING APPARATUS PERFORMING POST TREATMENT ACCOMPANIED WITH PERFORATION

CROSS-REFERENCE TO RELATED APPLICATIONS

This Nonprovisional application claims priority under 35 U.S.C. §119(a) on Patent Application No. 2004-45359 filed in Japan on Feb. 20, 2004, the entire contents of which are hereby incorporated by reference.

BACKGROUND OF THE INVENTION

The present invention relates to an image forming apparatus which reinforces a perforated portion of a recording medium having an image formed thereon.

Some image forming apparatuses, such as a copying machine and a printer device, have functions of performing a process such as stapling or punching for recording paper having an image formed thereon. When stapling a relatively small number of recording paper sheets, the turned tip portion of the staple may break through the recording paper from the reverse face to the right face. In the meantime, since punched recording paper sheets are bundled with a string or a binder, the punched portion becomes more breakable over time.

In view of such circumstances, disclosed in Japanese Patent Application Laid-Open No. H11-91283(1999) is a technique of attaching to the punched recording paper a reinforcing member for reinforcing the punched portion. Moreover, disclosed in Japanese Patent Application Laid-Open No. H9-123098(1997) is a technique of attaching a reinforcing member around a punched hole of the recording paper while punching the recording paper with the formation of an image, in order to reinforce the punched portion of the recording paper and keep the same from being broken easily.

Both of the conventional techniques use a method of attaching a prepared reinforcing member to the recording paper in order to reinforce the punched hole. The technique disclosed in Japanese Patent Application Laid-Open No. H11-91283 has a problem that it is troublesome since it requires operations of attaching a reinforcing member to each recording paper sheet. Moreover, the technique disclosed in Japanese Patent Application Laid-Open No. H9-123098 has a problem that it needs the reinforcing members to be prepared. Another problem thereof is that a plurality of bundled recording paper sheets take up much space since the thickness of each recording paper sheet is increased when the reinforcing member is attached thereto.

BRIEF SUMMARY OF THE INVENTION

The present invention has been made with the aim of solving the above problems, and it is an object thereof to provide an image forming apparatus capable of reinforcing a perforated portion of a recording medium with an additional image by forming the additional image on a portion, which is to be perforated by punching or stapling, of the recording medium as well as forming an original image on the recording medium.

An image forming apparatus according to the present invention is an image forming apparatus comprising image forming means for forming an image on a recording medium, further comprising additional image forming means for forming an additional image on the recording medium by filling a predetermined area including a portion, which is to be perforated, of the recording medium having the image formed thereon.

With the present invention, an additional image is formed by filling an area including a portion, which is to be perforated, of a recording medium on which an image is to be formed. By forming the additional image by filling the area including the perforated portion of punching or stapling of the recording medium, the thickness of the region around the perforated portion is increased, so that the recording medium is reinforced and kept from being broken easily while it is punched or stapled.

An image forming apparatus according to the present invention is an image forming apparatus comprising image forming means for forming an image on a recording medium and post treatment means for performing post treatment accompanied with perforation for the recording medium having the image formed thereon, further comprising additional image forming means for forming an additional image on the recording medium by filling a predetermined area including a portion to be perforated by the post treatment means.

With the present invention, the image forming apparatus comprising means for performing post treatment (punching and/or stapling) accompanied with perforation for a recording medium having an image formed thereon forms an additional image by filling an area including a portion, which is to be perforated, of the recording medium. When performing post treatment such as punching or stapling with the formation of the image on the recording medium, the recording medium is reinforced and kept from being broken easily by forming the additional image by filling the area including the perforated portion of punching or stapling. Since the recording medium is reinforced with the additional image formed by the image forming apparatus, the trouble of reinforcement can be reduced in comparison with a conventional method of attaching a reinforcing member. Moreover, since the thickness of the reinforced portion can be decreased in comparison with a recording medium having a reinforcing member attached thereto, it is possible to prevent the bundled recording paper sheets from taking up much space.

In an image forming apparatus according to the present invention, the post treatment means is designed to perform post treatment for a plurality of recording media collectively and the additional image forming means has means for forming an additional image on the first and the last recording media of the plurality of recording media for which the post treatment means performs post treatment collectively.

With the present invention, when stapling a plurality of bundled recording media for example, an additional image is formed only on the first and the last recording media of the plurality of recording media for which post treatment is performed collectively. Since the most breakable recording media are reinforced by forming the additional image only on the first and the last recording media when performing post treatment, such as stapling, collectively for a plurality of recording media, the recording media can be reinforced while minimizing the thickness of the bundled recording media.

In an image forming apparatus according to the present invention, the additional image forming means is designed to form an additional image using white developer or transparent developer. With the present invention, since white developer or transparent developer is used for forming the additional image, the additional image is unnoticeable.

In an image forming apparatus according to the present invention, the additional image forming means has means for forming an additional image on both sides of a recording medium. With the present invention, by forming the additional image on both sides of the recording medium, the recording paper can be reinforced further.

In an image forming apparatus according to the present invention, the additional image forming means has means for forming an additional image on the first and the last recording media of a plurality of recording media having images formed thereon in a case where the image forming means forms images on a plurality of recording media in succession. With the present invention, by forming the additional image only on the first and the last recording media of a plurality of recording media when forming images on the plurality of recording media in succession, such as a case of bundling of a plurality of recording media after punching every set of a predetermined number of recording media, the most breakable recording media are reinforced, so that the recording media can be reinforced while minimizing the entire thickness of the bundled recording media.

An image forming apparatus according to the present invention further comprises: judgment means for judging whether an image to be formed by the image forming means and an additional image to be formed by the additional image forming means are superposed or not; and image reduction means for reducing the image to be formed by the image forming means when the judgment means judges that the image and the additional image are superposed. With the present invention, when the image to be formed and the additional image are superposed, the image is formed on a reduced scale in order to avoid the superposition.

An image forming apparatus according to the present invention further comprises: judgment means for judging whether an image to be formed by the image forming means and an additional image to be formed by the additional image forming means are superposed or not; and position changing means for changing the position of the image to be formed on a recording medium by the image forming means when the judgment means judges that the image and the additional image are superposed. When the image to be formed and the additional image are superposed, the position of the image to be formed on the recording medium is changed in order to avoid the superposition.

With the present invention, since the superposition is avoided either by reducing the image or by changing the position of the image to be formed when the image and the additional image are superposed, the additional image is prevented from being damaged.

An image forming apparatus according to the present invention further comprises means for accepting a selection of whether the image reduction means is to reduce the image or not, when the judgment means judges that the image and the additional image are superposed. With the present invention, it is enabled to select whether the image is to be reduced or not when the image to be formed and the additional image are superposed.

An image forming apparatus according to the present invention further comprises means for accepting a selection of whether the position changing means is to change the position of the image or not, when the judgment means judges that the image and the additional image are superposed. With the present invention, it is enabled to select whether the position of the image is to be changed or not when the image to be formed and the additional image are superposed.

With the present invention, since it is possible to select whether the superposition of the image and the additional image is to be avoided by reducing the image or changing the position of the image or not, the recording medium can be reinforced depending on the situation by, for example, avoiding the superposition only when the contents of the image is an important document.

The above and further objects and features of the invention will more fully be apparent from the following detailed description with accompanying drawings.

DETAILED DESCRIPTION OF THE INVENTION

The following description will explain the present invention with reference to the drawings illustrating an embodiment thereof.

Figure 1:
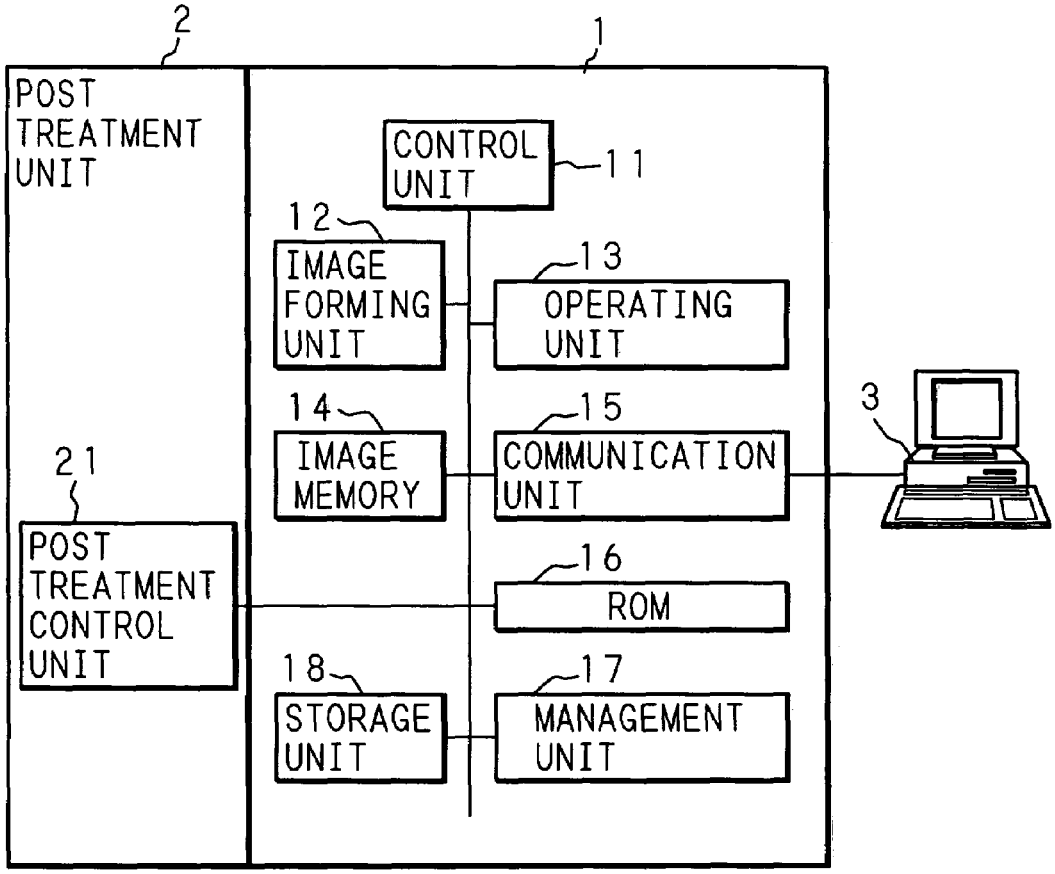
FIG. 1 is a functional block diagram showing the functional structure of the inside of an image forming apparatus according to the present invention.

FIG. 1 is a functional block diagram showing the functional structure of the inside of an image forming apparatus according to the present invention. An image forming apparatus 1 is a printer device which is connected with a personal computer (PC) 3 in order to receive image data transmitted from the PC 3 and perform processes for forming an image. The image forming apparatus 1 comprises a control unit 11 which has, for example, a CPU for carrying out operations and a RAM for storing temporary information associated with the operations. The control unit 11 is connected with a ROM 16 which stores a control program for controlling the image forming apparatus 1. The control unit 11 controls the whole of the image forming apparatus 1 according to the control program stored in the ROM 16. The control unit 11 is also connected with a management unit 17 which is a memory for storing management information for managing processes to be performed by the image forming apparatus 1. The control unit 11 refers to the management information stored in the management unit 17 and controls the image forming apparatus 1 on the basis of the referred-to information.

The control unit 11 is also connected with: a communication unit 15 connected with the PC 3; a storage unit 18 which is a hard disk or a nonvolatile memory; an image memory 14 for storing image data temporally; and an image forming unit 12. The communication unit 15 receives image data transmitted from the PC 3 and the storage unit 18 stores the image data received by the communication unit 15. The control unit 11 causes the image memory 14 to store the image data stored in the storage unit 18 by page and the image forming unit 12 forms an image on recording paper (recording medium) on the basis of the image data stored in the image memory 14. The control unit 11 is also connected with an operating unit 13 for accepting operations of users. The operating unit 13 includes a display, such as a liquid crystal panel, for displaying information required for operations of users, and an input unit, such as a touch panel or a ten key pad, through which indications are inputted with operations of users.

The image forming apparatus 1 also comprises a post treatment unit 2 which performs processes for the recording paper (recording medium) after the image forming unit 12 forms an image thereon. The post treatment unit 2 which functions as a stapler or a punch unit staples or punches the recording paper having an image formed thereon. The recording paper is to be perforated by the process of stapling or punching, after an image is formed thereon. The post treatment unit 2 comprises a post treatment control unit 21, which is connected with the control unit 11, for controlling the operations of the post treatment unit 2. The communication unit 15 capable of receiving an indication of post treatment with image data from the PC 3 causes the post treatment control unit 21 to perform processes of post treatment according to the indication of post treatment received by the communication unit 15.

Figure 2:
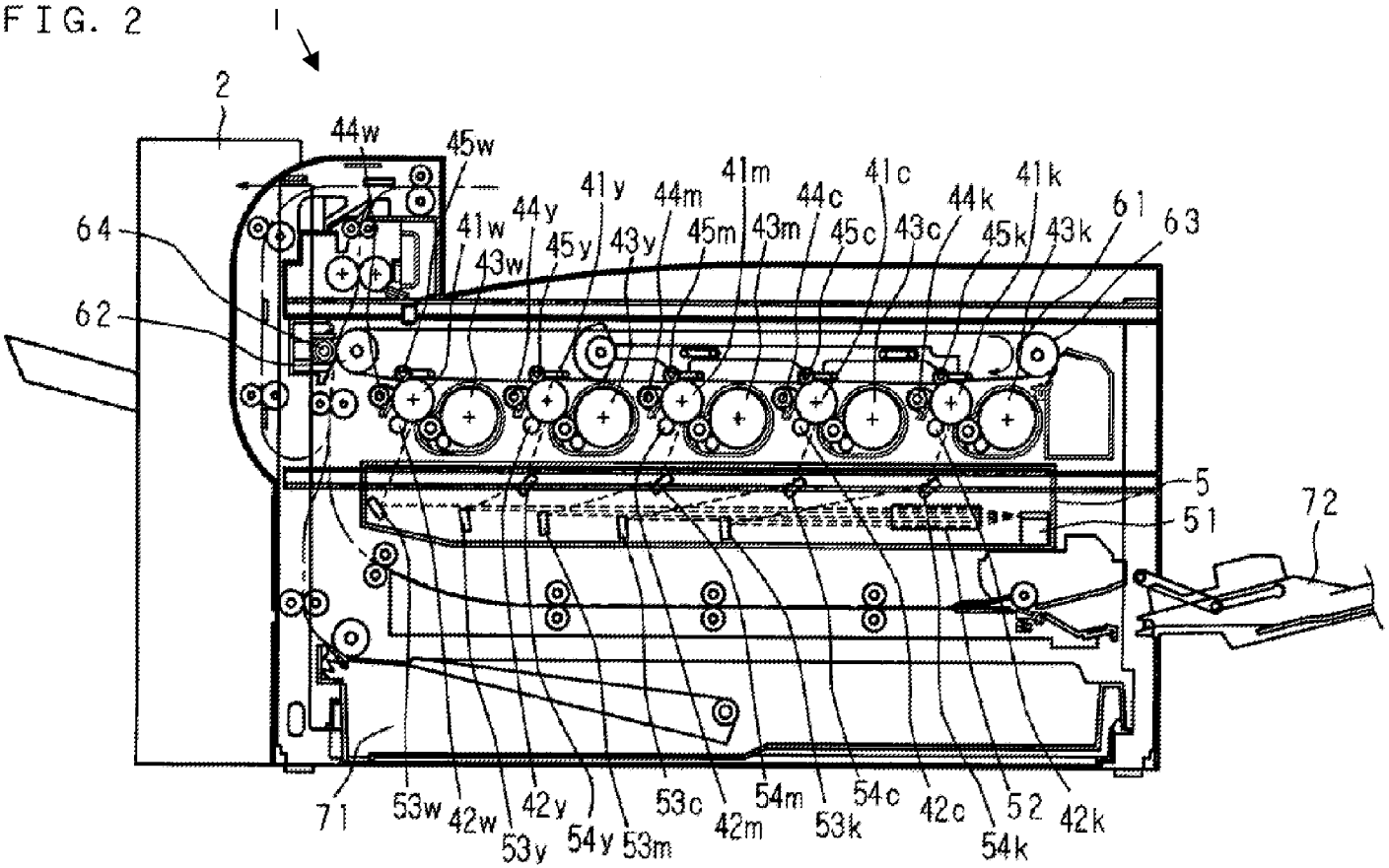
FIG. 2 is a sectional view illustrating the inside of the image forming apparatus according to the present invention.

FIG. 2 is a sectional view illustrating the inside of the image forming apparatus 1 according to the present invention. The image forming apparatus 1 is constructed to perform processes for forming a multicolor image with toner of colors of black (K), cyan (C), magenta (M) and yellow (Y) and further forming an additional image according to the present invention with white toner. The image forming apparatus 1 comprises: photoconductor drums 41*k*, 41*c*, 41*m*, 41*y* and 41*w*; charging elements 42*k*, 42*c*, 42*m*, 42*y* and 42*w*; developing elements 43*k*, 43*c*, 43*m*, 43*y* and 43*w*; and cleaner units 44*k*, 44*c*, 44*m*, 44*y* and 44*w*. The symbols "k", "c", "m", "y" and "w" added to the respective codes respectively correspond to black, cyan, magenta, yellow and white. A photoconductor drum, a charging element, a developing element and a cleaner unit constitute one set for each color, and five sets corresponding to black, cyan, magenta, yellow and white are arranged linearly.

The image forming apparatus 1 also comprises, under the photoconductor drums 41*k*, 41*c*, 41*m*, 41*y*and 41*w*, a light exposure unit 5 for emitting a laser beam in order to generate electrostatic latent images on the photoconductor drums 41*k*, 41*c*, 41*m*, 41*y* and 41*w*. The light exposure unit 5 comprises a laser irradiation unit 51 and a polygon mirror 52. The light exposure unit 5 is also provided with: a reflecting mirror 53*k* for reflecting a laser beam which is emitted from the laser irradiation unit 51 and scanned by the rotation of the polygon mirror 52; and a reflecting mirror 54*k* for farther reflecting the laser beam reflected by the reflecting mirror 53*k*in order to irradiate the photoconductor drum 41*k*. Similarly, the light exposure unit 5 is also provided with reflecting mirrors 53*c* and 54*c*, 53*m* and 54*m*, and 53*y* and 54*y*, which correspond to the photoconductor drums 41*c*, 41*m* and 4l*y*. The light exposure unit 5 is further provided with a reflecting mirror 53*w* for reflecting a laser beam which is emitted from the laser irradiation unit 51 and scanned by the rotation of the polygon mirror 52 in order to irradiate the photoconductor drum 41*w*.

The charging element 42*k*, which is constructed to come in contact with the photoconductor drum 41*k*, charges the surface of the photoconductor drum 41*k* uniformly at a predetermined potential. The developing element 43*k* contains black toner and supplies the black toner to an electrostatic latent image formed on the surface of the photoconductor drum 41*k* by the light exposure unit 5, in order to make the image visible. The cleaner unit 44*k* recovers and removes the toner remaining on the surface of the photoconductor drum 41*k* after transferring the image. The photoconductor drums, charging elements, developing elements and cleaner units corresponding respectively to cyan, magenta, yellow and white are similar in construction and make images of the respective colors visible.

The image forming apparatus 1 also comprises, above the photoconductor drums 41*k*, 41*c*, 41*m*, 41*y* and 41*w*, a transfer belt 61 to which the toner images on the photoconductor drums 41*k*, 41*c*, 41*m*, 41*y* and 41*w* are to be transferred. The transfer belt 61 is suspended between a transfer belt driving roller 62 and a transfer belt driven roller 63, and is constructed to rotate in the direction of an arrow shown in the figure by the driving force of the transfer belt driving roller 62. The transfer belt 61 is arranged with the surface thereof being in contact with the photoconductor drums 41*k*, 41*c*, 41*m*, 41*y* and 41*w*, and intermediate transfer rollers 45*k*, 45*c*, 45*m*, 45*y* and 45*w* are provided so as to oppose the photoconductor drums 41*k*, 41*c*, 41*m*, 41*y* and 41*w* across the transfer belt 61. The intermediate transfer roller 45*k* is in contact with the reverse side of the transfer belt 61 and is supplied with a voltage for transferring a toner image on the photoconductor drum 41*k* to the transfer belt 61 i.e. a high voltage of reverse polarity (+) from the charge polarity (−) of the toner. The intermediate transfer roller 45*k* applies a high voltage to the transfer belt 61 uniformly in order to transfer the toner image on the photoconductor drum 45*k* to the transfer belt 61. The intermediate transfer rollers 45*c*, 45*m*, 45*y* and 45*w* corresponding respectively to cyan, magenta, yellow and white are similar in construction and transfer toner images of the respective colors to the transfer belt 61.

The image forming apparatus 1 also comprises a paper feeding tray 71 and a manual paper feeding tray 72 which contain recording paper. The image forming apparatus 1 also comprises a transfer roller 64 which opposes the transfer belt driving roller 62 across the transfer belt 61. The recording paper contained in the paper feeding tray 71 and the manual paper feeding tray 72 are conveyed through a path shown in one dot chain line in the figure to the space between the transfer belt 61 and the transfer roller 64. As described above, the electrostatic latent images which are made visible on the photoconductor drums 41*k*, 41*c*, 41*m*, 41*y* and 41*w* for the respective colors are sequentially transferred to the transfer belt 61 so that an image rendered as a multicolor toner image is formed on the transfer belt 61. The multicolor toner image on the transfer belt 61 is moved with the rotation of the transfer belt 61 and is transferred to the recording paper which has been conveyed to the space between the transfer belt 61 and the transfer roller 64. At this moment, the transfer belt 61 and the transfer roller 64 are pressed against each other across the recording paper, and the transfer roller 64 is supplied with a voltage for transferring the multicolor toner image on the transfer belt 61 to the recording paper, i.e., a high voltage of reverse polarity (+) from the charge polarity (−) of the toner. Thus, an image is formed on the recording paper by transferring the multicolor toner image to the recording paper. The recording paper having an image formed thereon is ejected from the image forming apparatus 1 through the rest of the path, conveyed to the space between the transfer belt 61 and the transfer roller 64 again in order to form an image on the reverse side thereof, or conveyed to the post treatment unit 2 for undergoing post treatment.

Figure 3A:
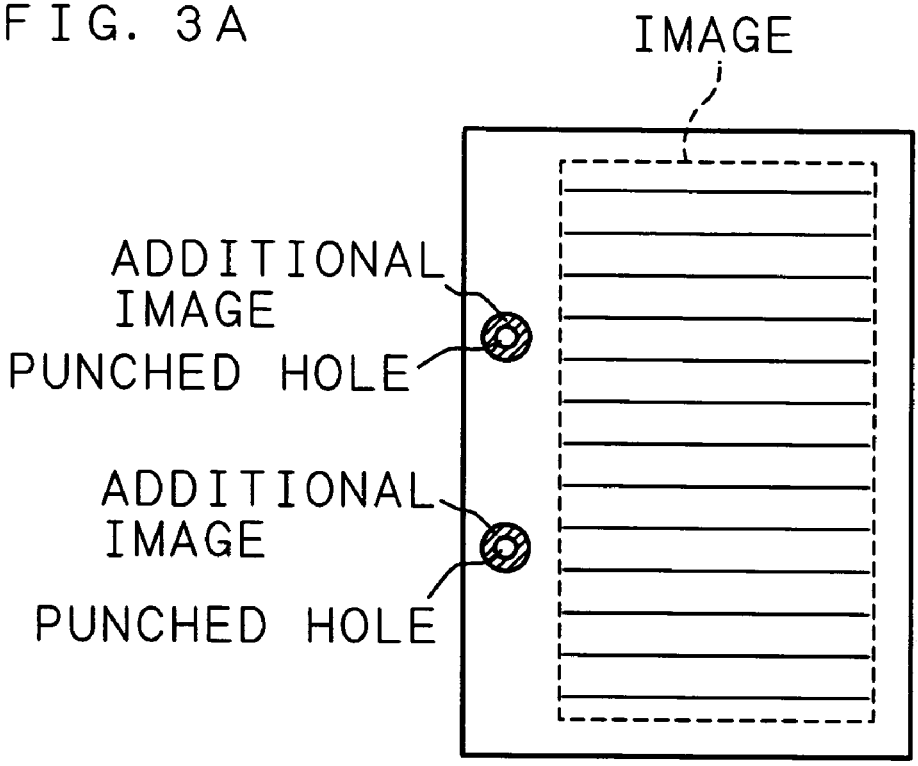
FIGS. 3A and 3B are schematic views respectively showing an example of an image formed on recording paper by the image forming apparatus according to the present invention.
Figure 3B:
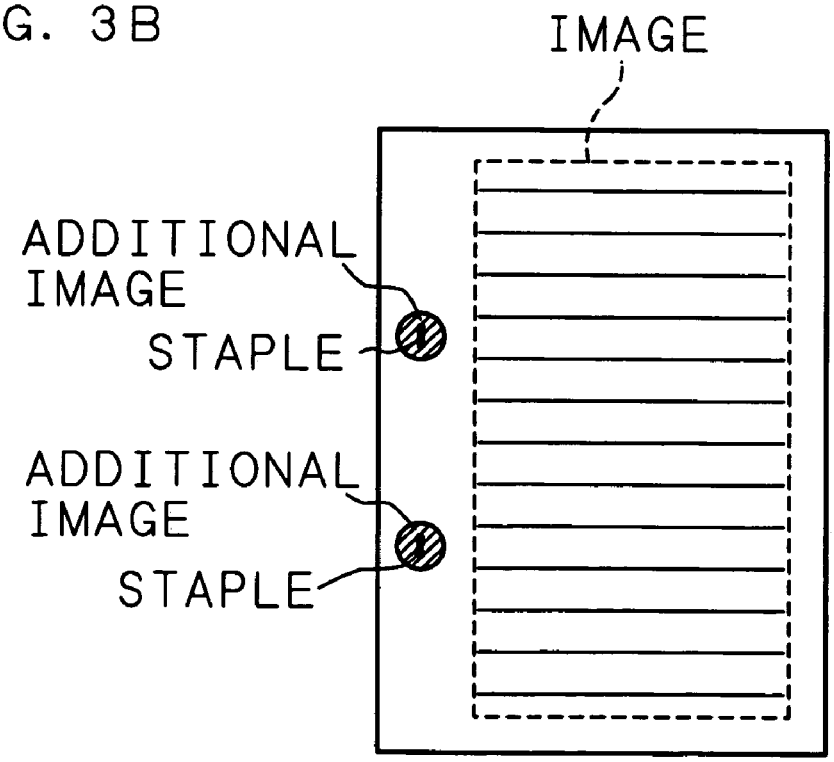

FIGS. 3A and 3B are schematic views respectively showing an example of an image formed on the recording paper by the image forming apparatus 1 according to the present invention. FIG. 3A shows an example of recording paper punched by the post treatment unit 2 and FIG. 3B shows an example of recording paper stapled by the post treatment unit 2. On the recording paper, an additional image is formed by filling a predetermined area including a punched portion or a stapled portion, in addition to an original image, such as a text document, to be formed by the image forming apparatus 1. The additional image is formed with white toner (white developer) contained in the developing element 43*w*. Since the thickness of the recording paper is increased by the white toner forming the additional image, the region around the punched portion or the stapled portion, which is a perforated portion, is reinforced. The white toner is prepared using white coloring agent, such as titanium white, as coloring agent to be included in normal toner consisting primarily of resin. It should be noted that transparent toner (transparent developer) may be used instead of white toner as the toner for forming the additional image. The transparent toner is prepared by not adding coloring agent into normal toner. The form of the additional image is not limited to the ones shown in FIGS. 3A and 3B, but may be other forms such as a form made up by filling a wider area.

The PC 3 transmits an indication of image formation and image data to be formed to the image forming apparatus 1 when the user operates the PC 3. At this moment, the PC 3 can transmit indications including an indication of post treatment and an indication of additional image formation, as the indication of image formation. The PC 3 can also transmit an indication for forming an additional image only on the first and the last recording paper sheets of a plurality of recording paper sheets having images formed thereon in succession, as the indication of additional image formation. In this manner, when a plurality of recording paper sheets are punched for example, the first and the last recording paper sheets of the plurality of recording paper sheets to be punched and bundled are reinforced with the additional images. The PC 3 also can transmit an indication for forming an additional image only on the fist and the last recording paper sheets of a set of a plurality of recording paper sheets for which post treatment is to be performed collectively, as the indication of additional image formation. In this manner, the first and the last recording paper sheets of a plurality of recording paper sheets to be stapled, for example, are reinforced with the additional images.

Figure 4:
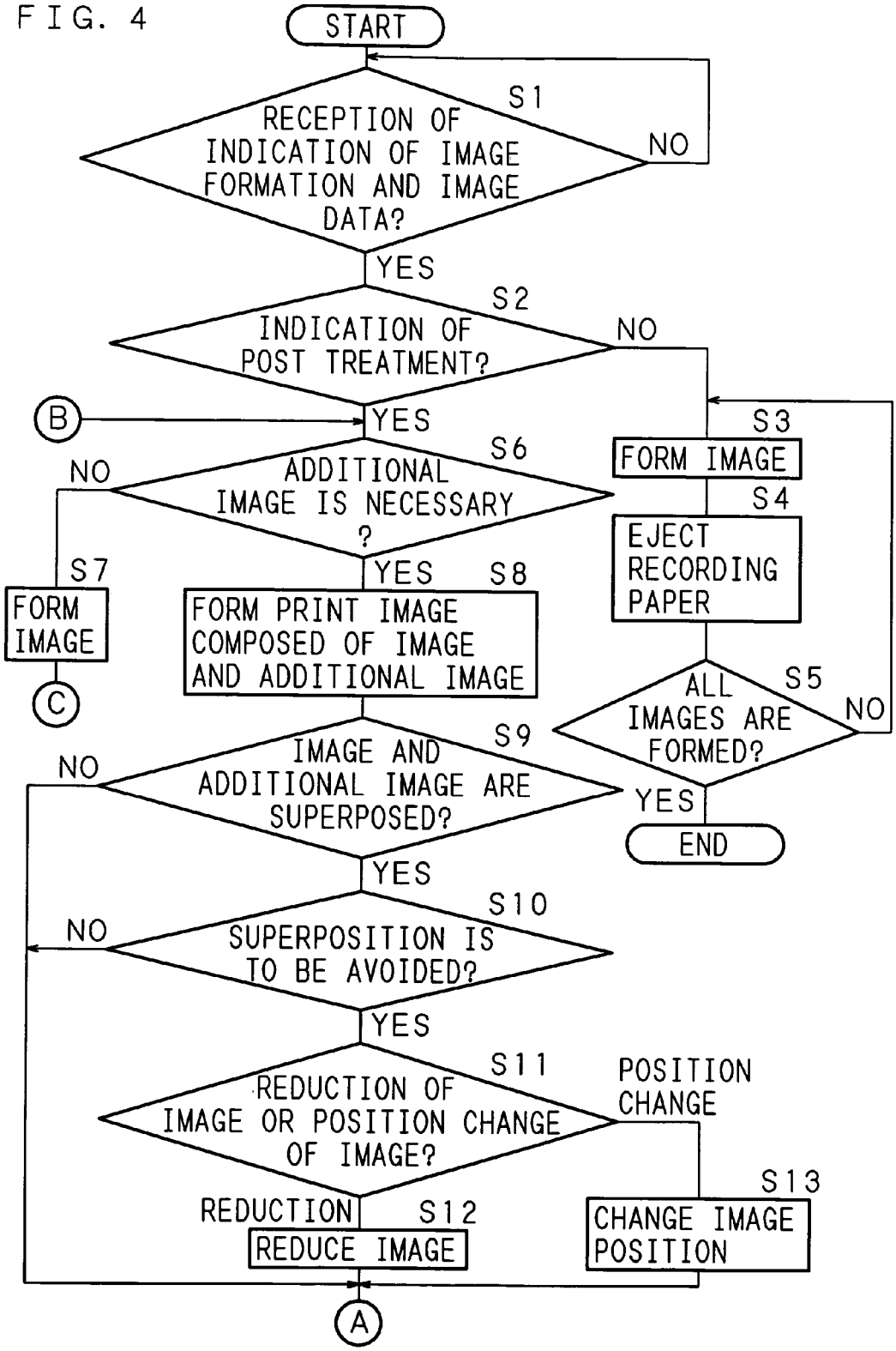
FIG. 4 is a flow chart showing the process procedure to be performed by the image forming apparatus according to the present invention.
Figure 5:
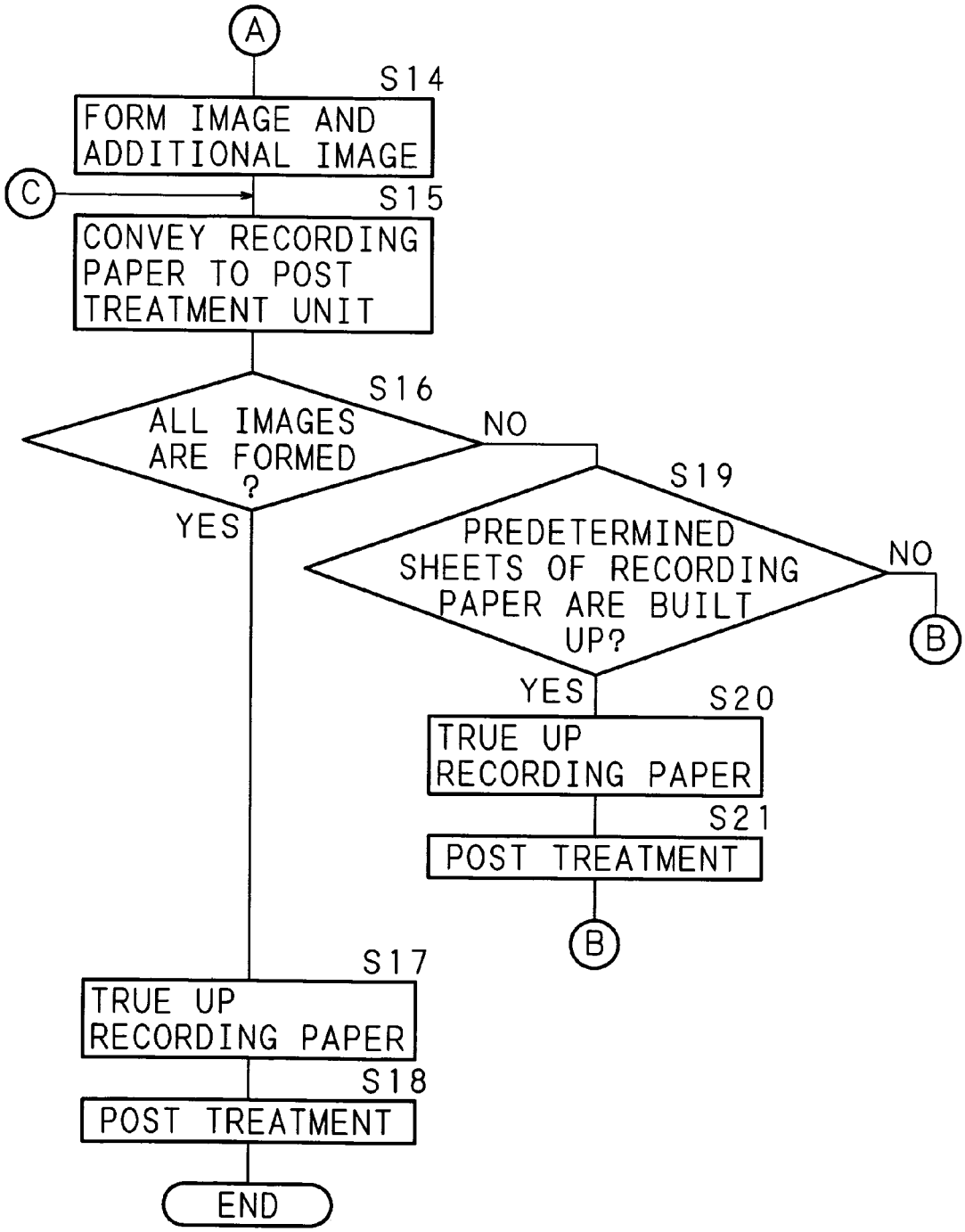
FIG. 5 is a flow chart showing the process procedure to be performed by the image forming apparatus according to the present invention.

FIGS. 4 and 5 are flow charts showing the process procedure to be performed by the image forming apparatus 1 according to the present invention. The control unit 11 of the image forming apparatus 1 performs the following process according to the control program stored in the ROM 16. The control unit 11 monitors reception of an indication of image formation and image data, which are transmitted from the PC 3, by the communication unit 15 (S1). When an indication of image formation and image data are not received (S1: NO), the control unit 11 continues monitoring reception of an indication of image formation and image data. When the communication unit 15 receives an indication of image formation and image data transmitted from the PC 3 (S1: YES), the control unit 11 judges whether the received indication of image formation includes an indication of post treatment of punching or stapling or not (S2). When the indication of image formation does not include an indication of post treatment (S2: NO), the control unit 11 causes the image forming unit 12 to form an image on the basis of the received image data (S3) and ejects recording paper having the image formed thereon (S4). The control unit 11 then judges whether all images associated with the received image data have been formed or not (S5). When any image remains unformed (S5: NO), the process goes back to the step S3. When all images have been formed (S5: YES), the process is terminated.

When it is judged in the step S2 that the indication of image formation includes an indication of post treatment (S2: YES), the control unit 11 judges whether formation of an additional image is necessary or not (S6). At this moment, the control unit 11 judges that the formation of an additional image is necessary when the indication of image formation includes an indication of additional image formation. When an indication for forming an additional image only on the first and the last recording paper sheets of a plurality of recording paper sheets has been received, the control unit 11 judges whether the next recording paper sheet on which an image is to be formed is recording paper to which an additional image is to be formed or not, in order to judge whether formation of an additional image is necessary or not. When formation of an additional image is unnecessary (S6: NO), the control unit 11 causes the image forming unit 12 to form an image on the basis of the received image data (S7) and advances the process to a step S15.

When it is judged in the step S6 that formation of an additional image is necessary (S6: YES), the control unit 11 forms a print image of one page composed of an image based on the received image data; and an additional image formed by filling a predetermined area including a perforated portion of punching or stapling which is to be performed in post treatment (S8). The control unit 11 then judges whether the image and the additional image which compose the print image are superposed or not (S9). When the image and the additional image are superposed (S9: YES), the control unit 11 judges whether the superposition of the image and the additional image is to be avoided or not (S10). At this moment, when the indication of image formation includes an indication about whether the superposition is to be avoided or not, the control unit 11 judges whether the superposition is to be avoided or not according to the indication. The control unit 11 can also make a judgment by causing the communication unit 15 to transmit to the PC 3 information on a request for a selection of whether the superposition is to be avoided or not, and receiving from the PC 3 the selection of whether the superposition is to be avoided or not which is accepted from the user through the PC 3. The control unit 11 can also make a judgment by causing the display of the operating unit 13 to display a request for a selection of whether the superposition is to be avoided or not, and accepting through the operating unit 13 the selection of whether the superposition is to be avoided or not with an operation by the user.

When it is judged in step S10 that the superposition of the image and the additional image is to be avoided (S10: YES), the control unit 11 selects one method from reducing the image and changing the position of the image to be formed, as a method for avoiding the superposition (S11). At this moment, when the indication of image formation includes an indication of a method for avoiding the superposition, the control unit 11 selects the indicated method. The control unit 11 can also make a selection by causing the communication unit 15 to transmit to the PC 3 information on a request for a selection of a method for avoiding the superposition, and receiving specification of a method from the PC 3. The control unit 11 can also make a selection by causing the display of the operating unit 13 to display a request for a selection of a method for avoiding the superposition, and accepting the selection of a method through the operating unit 13. A method for avoiding the superposition may be selected by accepting, with an operation of the user, a selection of whether the image is to be reduced or not, or whether the position of the image to be formed is to be changed or not, while accepting a selection of whether the superposition of the image and the additional image is to be avoided or not in step S10.

When reduction of an image is selected in the step S11, the control unit 11 calculates an image reduction ratio for avoiding the superposition on the basis of the distance from the center position of the image to the position of superposition, and reduces the image to be formed (S12). When a position change of the image is selected in the step S11, the control unit 11 calculates the amount of position change of the image for avoiding the superposition on the basis of the amount of superposition of the image and the additional image, and changes the position of the image to be formed on the recording paper (S13).

Figure 6C:
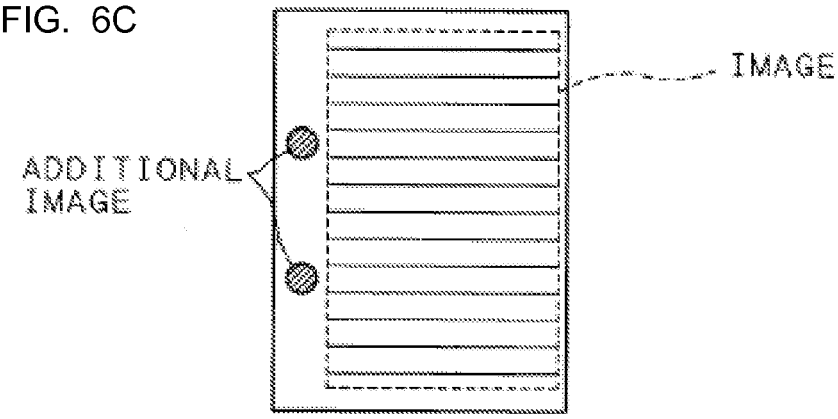
FIGS. 6A to 6C are schematic views showing examples of avoidance of the superposition of an image and an additional image.
Figure 6B:
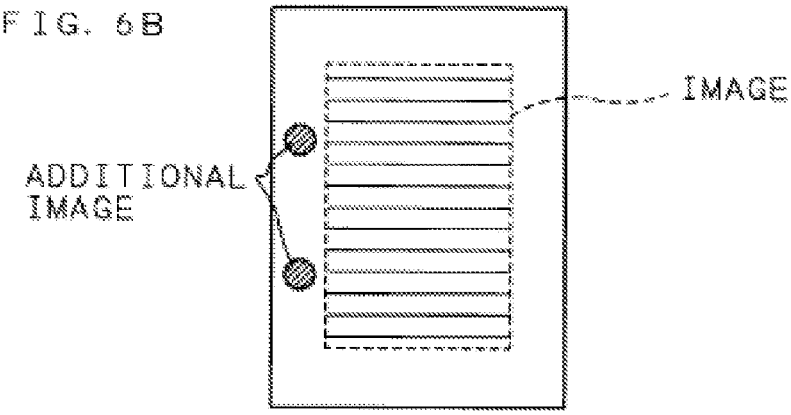
Figure 6A:
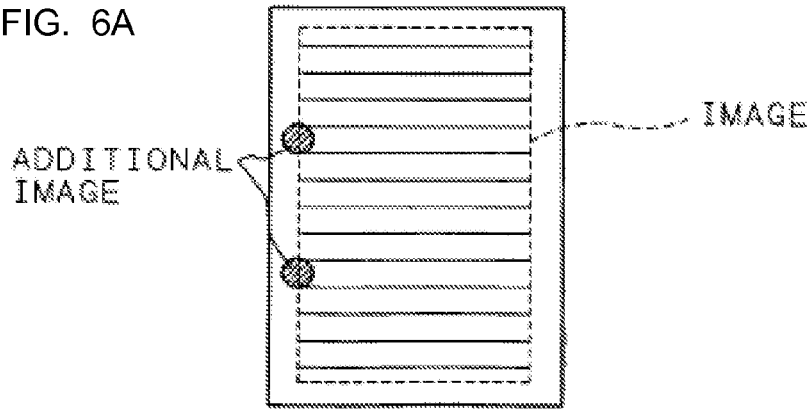

FIGS. 6A to 6C are schematic views showing examples of avoidance of the superposition of an image and an additional image. The superposition is avoided when the area of an image and the area of an additional image are superposed as shown in FIG. 6A. When reducing the image, the image is reduced toward the center so that the image and the additional image are kept from being superposed, as shown in FIG. 6B. When changing the position of the image, the position of the image is changed in a direction away from the additional image so that the image and the additional image are kept from being superposed, as shown in FIG. 6C.

The control unit 11 causes the image forming unit 12 to form an image based on the received image data and an additional image (S14) when it is judged in step S9 that the image and the additional image are not superposed (S9: NO), when it is judged in step S10 that the superposition of the image and the additional image is not to be avoided (S10: NO), and when step S12 or step S13 is completed. It should be noted that a process for forming an additional image on both sides of the recording paper may be performed at this moment. In this case, the recording paper can be reinforced further. When the process of step S7 or step S14 is completed, the control unit 11 causes the recording paper having an image formed thereon to be conveyed to the post treatment unit 2 (S15).

The control unit 11 then judges whether all the images associated with the received image data have been formed or not (S16). When all the images have been formed (S16: YES), the control unit 11 causes the post treatment control unit 21 to true up the recording paper sheets built up in the post treatment unit 2 (S17) and perform indicated post treatment of punching or stapling (S18), and terminates the process.

When it is judged in the step S16 that any image remains unformed (S16: NO), the control unit 11 judges whether a predetermined number of recording paper sheets are built up in the post treatment unit 2 or not (S19). In a case where the post treatment is punching, the predetermined number here corresponds to the capability of the post treatment unit 2 for bundling and punching a plurality of recording paper sheets at a time. In a case where the post treatment is stapling, the predetermined number here corresponds to the capability of the post treatment unit 2 for bundling and stapling a plurality of recording paper sheets or to an indication of the number of the recording paper sheets to be stapled which is included in the indication of post treatment. When a predetermined number of recording paper sheets have not been built up (S19: NO), the control unit 11 returns the process to step S6. When a predetermined number of recording paper sheets have been built up in the post treatment unit 2 (S19: YES), the control unit 11 causes the post treatment control unit 21 to true up the recording paper sheets built up in the post treatment unit 2 (S20) and perform an indicated post treatment of punching or stapling (S21), and returns the process to step S6.

As described above in detail, with the present invention, an additional image is formed by filling an area including a perforated portion of punching or stapling in a case where post treatment of punching or stapling is performed for the recording paper with the formation of an image. Since the thickness of the region around the punched portion or the stapled portion is increased by the additional image, the recording paper is reinforced and kept from being broken easily. Since the recording paper is reinforced by an additional image formed by the image forming apparatus 1, the trouble of reinforcement can be reduced in comparison with a conventional method of attaching a reinforcing member. Moreover, since the thickness of the reinforced portion is decreased in comparison with recording paper having a reinforcing member attached thereto, it is possible to prevent the bundled recording paper sheets from taking up space.

Moreover, with the present invention, an additional image is formed only on the first and the last recording paper sheets of a plurality of recording paper sheets to be bundled and punched, or only on the first and the last recording paper sheets of a plurality of recording paper sheets to be bundled and stapled. By reinforcing the most breakable recording paper sheets in this manner, the recording paper sheets can be reinforced while minimizing the total thickness of the bundled recording paper sheets. Moreover, with the present invention, since white developer or transparent developer is used for forming an additional image, the additional image is unnoticeable. Moreover, with the present invention, since superposition is avoided either by reducing an image or by changing the position of the image to be formed when the image and the additional image are superposed, the additional image is prevented from being damaged. Moreover, since a selection of whether the superposition is to be avoided by reducing the image or changing the position of the image or not can be accepted from the user when the image and the additional image are superposed, the user can reinforce the recording paper depending on the situation by, for example, avoiding the superposition when the contents of the image is an important document.

It should be noted that, though the image forming apparatus 1 according to the present invention comprises a post treatment unit 2 in the above embodiment, the present invention is not limited to this but an additional image may be preliminarily formed on the recording paper to which post treatment is to be performed, by another apparatus. Moreover, the image forming apparatus 1 according to the present invention may have a post treatment unit 2 which is an optional and detachable device.

Moreover, though the image forming apparatus 1 according to the present invention is a printer device for receiving image data from the PC 3 and forming an image in the above embodiment, the present invention is not limited to this but the image forming apparatus 1 may be a copying machine provided with functions of reading an image recorded on an original copy and forming an additional image while copying the image.

Moreover, though the image forming apparatus 1 according to the present invention forms a color image with multicolor toner in the above embodiment, the present invention is not limited to this but the image forming apparatus 1 may form a monochromatic image with only black toner. Moreover, though toner for forming an additional image is provided in addition to toner for forming an original image in the above embodiment, the present invention is not limited to this but an additional image may be formed with black toner or multicolor toner. In particular, when the recording paper has a color other than white, an additional image may be formed with the same color as the recording paper.

Moreover, though the image forming apparatus 1 according to the present invention is an electrophotographic image forming apparatus in the above embodiment, the present invention is not limited to this but the image forming apparatus 1 may form an image using another method such as thermal transfer.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming unit for forming an image on a recording medium; and an additional image forming unit for forming an additional image on the recording medium by filling a predetermined area including a portion, which is to be perforated, of the recording medium having the image formed thereon, the predetermined area including a filled area which remains on the recording medium following the perforation so as to reinforce the perforated portion.

2. The image forming apparatus according to claim 1, wherein the additional image forming unit forms the additional image using white developer or transparent developer.

3. The image forming apparatus according to claim 1, wherein the additional image forming unit forms the additional image on both sides of the recording medium.

4. The image forming apparatus according to claim 1, wherein the additional image forming unit forms the additional image on the first and the last recording media of a plurality of recording media having images formed thereon, when the image forming unit forms the images on the plurality of recording media in succession.

5. An image forming apparatus comprising:

an image forming unit for forming an image on a recording medium;

an additional image forming unit for forming an additional image on the recording medium by filling a predetermined area including a portion, which is to be perforated, of the recording medium having the image formed thereon;

a judgment unit for judging whether an image to be formed by the image forming unit and the additional image to be formed by the additional image forming unit are superposed or not; and an image reduction unit for reducing the image to be formed by the image forming unit when the judgment unit judges that the image and the additional image are superposed.

6. The image forming apparatus according to claim 5, further comprising an accepting unit for accepting a selection of whether the image reduction unit is to reduce the image or not, when the judgment unit judges that the image and the additional image are superposed.

7. An image forming apparatus comprising:

an image forming unit for forming an image on a recording medium;

an additional image forming unit for forming an additional image on the recording medium by filling a predetermined area including a portion, which is to be perforated, of the recording medium having the image formed thereon;

a judgment unit for judging whether an image to be formed by the image forming unit and the additional image to be formed by the additional image forming unit are superposed or not; and a position changing unit for changing a position of the image to be formed on the recording medium by the image forming unit when the judgment unit judges that the image and the additional image are superposed.

8. The image forming apparatus according to claim 7, further comprising an accepting unit for accepting a selection of whether the position changing unit is to change the position of the image or not, when the judgment unit judges that the image and the additional image are superposed.

9. An image forming apparatus comprising:

an image forming unit for forming an image on a recording medium;

a post treatment unit for performing post treatment accompanied with perforation for the recording medium having the image formed thereon; and an additional image forming unit for forming an additional image on the recording medium by filling a predetermined area including a portion to be perforated by the post treatment unit, the predetermined area including a filled area which remains on the recording medium following the perforation so as to reinforce the perforated portion.

10. The image forming apparatus according to claim 9, wherein the post treatment unit punches and/or staples the recording medium.

11. The image forming apparatus according to claim 9, wherein the post treatment unit performs post treatment for a plurality of recording media collectively and the additional image forming unit forms the additional image on the first and the last recording media of the plurality of recording media for which the post treatment unit performs post treatment collectively.

12. The image forming apparatus according to claim 9, wherein the additional image forming unit forms the additional image using white developer or transparent developer.

13. The image forming apparatus according to claim 9, wherein the additional image forming unit forms the additional image on both sides of the recording medium.

14. The image forming apparatus according to claim 9, wherein the additional image forming unit forms the additional image on the first and the last recording media of a plurality of recording media having images formed thereon, when the image forming unit forms the images on the plurality of recording media in succession.

15. The image forming apparatus according to claim 9, further comprising:

a judgment unit for judging whether an image to be formed by the image forming unit and the additional image to be formed by the additional image forming unit are superposed or not; and an image reduction unit for reducing the image to be formed by the image forming unit when the judgment unit judges that the image and the additional image are superposed.

16. The image forming apparatus according to claim 15, further comprising an accepting unit for accepting a selection of whether the image reduction unit is to reduce the image or not, when the judgment unit judges that the image and the additional image are superposed.

17. The image forming apparatus according to claim 9, further comprising:

a judgment unit for judging whether an image to be formed by the image forming unit and the additional image to be formed by the additional image forming unit are superposed or not; and a position changing unit for changing a position of the image to be formed on the recording medium by the image forming unit when the judgment unit judges that the image and the additional image are superposed.

18. The image forming apparatus according to claim 17, further comprising an accepting unit for accepting a selection of whether the position changing unit is to change the position of the image or not, when the judgment unit judges that the image and the additional image are superposed.

* * * * *